US009045834B2

(12) United States Patent
Lambourne

(10) Patent No.: US 9,045,834 B2
(45) Date of Patent: Jun. 2, 2015

(54) SACRIFICIAL ANODE

(71) Applicant: ROLLS-ROYCE PLC, London (GB)

(72) Inventor: Alexis Lambourne, Belper (GB)

(73) Assignee: ROLLS-ROYCE PLC, London (GB)

( * ) Notice: Subject to any disclaimer, the term of this patent is extended or adjusted under 35 U.S.C. 154(b) by 254 days.

(21) Appl. No.: 13/657,288

(22) Filed: Oct. 22, 2012

(65) Prior Publication Data

US 2013/0118915 A1 May 16, 2013

(30) Foreign Application Priority Data

Nov. 11, 2011 (GB) ..... 1119446.1

(51) Int. Cl.

| | |
|---|---|
| ***C23F 13/00*** | (2006.01) |
| ***C23F 13/10*** | (2006.01) |
| ***C23F 13/22*** | (2006.01) |
| ***C23F 13/16*** | (2006.01) |

(52) U.S. Cl.

CPC ..... *C23F 13/22* (2013.01); *C23F 13/16* (2013.01); *C23F 2213/30* (2013.01)

(58) Field of Classification Search

CPC ..... C23F 13/14; C23F 13/18; C23F 13/22; C23F 2201/00; C23F 2213/20; C23F 2113/21; C23F 2213/31; C23F 13/10

USPC ..... 204/196.06, 196.3, 196.37; 205/725, 205/735, 736, 740

See application file for complete search history.

(56) References Cited

U.S. PATENT DOCUMENTS

| | | | | |
|---|---|---|---|---|
| 3,891,530 | A | 6/1975 | Alewitz | |
| 2010/0252424 | A1 * | 10/2010 | Amano et al. | 204/288.4 |
| 2011/0284367 | A1 | 11/2011 | Goller et al. | |
| 2011/0308967 | A1 * | 12/2011 | Byrne | 205/730 |

FOREIGN PATENT DOCUMENTS

| | | | |
|---|---|---|---|
| CN | 201372311 | Y | 12/2009 |
| GB | 980860 | | 1/1965 |
| GB | 2450827 | A | 1/2009 |
| JP | A-08035085 | | 2/1996 |
| KR | 20050010133 | | 1/2005 |
| WO | WO 2007/124034 | A2 | 11/2007 |

OTHER PUBLICATIONS

Yinglong (Machine Translation of CN 201372311).*

Mar. 7, 2012 Search Report issued in British Application No. 1119446.1.

* cited by examiner

*Primary Examiner* — Luan Van
*Assistant Examiner* — Alexander W Keeling
(74) *Attorney, Agent, or Firm* — Oliff PLC

(57) ABSTRACT

This invention relates to a sacrificial anode, comprising: a first layer of a first material; and, a second layer of a second material which is electrically connected to the first layer, wherein the first material is more anodic with respect to a galvanic series than the second material. The invention also relates to a body including the sacrificial anode.

12 Claims, 2 Drawing Sheets

SACRIFICIAL ANODE

TECHNICAL FIELD OF INVENTION

This invention relates to a sacrificial anode. In particular, this invention relates to a sacrificial anode made from two materials, one material being higher galvanic series relative to the other.

BACKGROUND OF INVENTION

It is well known to use sacrificial anodes to prevent corrosion of metallic bodies in corrosive environments, such as sea water. Such sacrificial anodes are typically metallic members which are mounted local to or on the body they are to protect and are more susceptible to galvanic corrosion in the given environment in which they are located and thus more anodic. As the sacrificial anode is more anodic (less noble) than the metal of the parent structure a small localised electrochemical cell is set up between the anode and the body which is to be protected when placed in an electrolyte such as sea water. In this way, corrosion of the metallic body is reduced, if not entirely prevented. The anodes are sacrificial in that they corrode during the process and require periodic replacement.

It is common practice to use surface mounted sacrificial anodes which are readily replaced when necessary. However, surface mounted sacrificial anodes represent a hydrodynamic penalty in the form of increased drag in conditions where the body is subjected to a constrained flow of water, such as a pipe or duct or in unconstrained flow such as on the rudder of a ship. The additional drag is generally undesirable.

One option for overcoming the hydrodynamic penalty is to use an impressed current cathodic protection system which utilises a permanent (non consumable) anode through which a current is passed during operation. This has the advantage that the anode can have a much reduced profile and represents a lower hydrodynamic penalty. However, the complexity and cost of such a system is too high for many applications.

The present invention seeks to provide a sacrificial anode which seeks to overcome some of the problems of the known systems.

STATEMENTS OF INVENTION

In a first aspect the present invention provides a sacrificial anode, comprising: a first layer of a first material; and, a second layer of a second material which is closely connected to the first layer, wherein the first material is more anodic with respect to a galvanic series than the second material.

Providing a first and second material in this way provides a sacrificial anode in which can be recessed into a body whilst the underside of the anode corrodes and the upper side remains intact, thereby preserving the hydrodynamic shape of the body in which the anode is recessed.

The first material and second material may be directly bonded together. The first material may be zinc. The second material may be magnesium. It will be appreciated, with reference to the electrochemical series, that other combinations of material may be used. The combinations of materials must ensure the galvanic relationship between the two is preserved such that the first material is more anodic than the second material. And, where the anode is recessed within a body, the second material is more anodic than the body.

The ratio of the first material to the second material may be between approximately 1:5 and 1:12.

In a second aspect, the present invention provides a metallic body comprising: a recess; and, the sacrificial anode as claimed in any preceding claim located within the recess and separated from the body by a channel, wherein the body is more cathodic with respect to a galvanic series than the first and second materials. The channel may substantially surrounds the anode.

The recess may have an opening to a fluid flow in normal use. The opening may have a first dimension. The sacrificial anode may extend across up to 90% of the first dimension.

The recess may be located in a fluid washed surface and a surface of the first material is located in the same plane as the fluid washed surface.

At least one edge between the fluid washed surface and a surface of the recess may be shaped to encourage a flow of fluid into the recess.

The at least one edge may have a curved profile which subtends between the fluid washed surface and surface of the recess.

In a third aspect, the present invention provides a water jet propulsion unit comprising the body according to the second aspect.

The body may form at least part of a duct through which water may be propelled when the propulsion unit is in normal use.

In a fourth aspect, the present invention may provide a method of inspecting a sacrificial anode as claimed in claim any preceding claim, comprising: visually inspecting the first material; determining whether the corrosion of the first material is greater or lesser than a predetermined acceptable amount; and, replacing the anode if the corrosion of the first material is greater than the predetermined amount.

Initiation of corrosion on the first material indicates consumption of the second material, indicating the need to replace the entire anode.

DESCRIPTION OF DRAWINGS

Embodiments of the invention will now be described with the aid of the following drawings in which.

DETAILED DESCRIPTION OF INVENTION

Figure 1A:
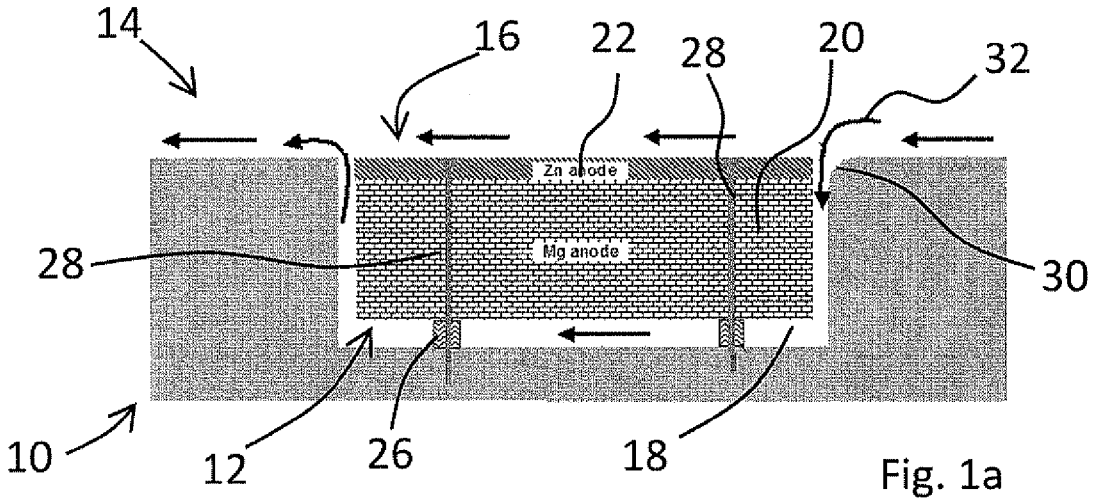
FIGS. 1*a, b* and *c* shows a sacrificial anode according to the present invention prior to, during and after a period of corrosion

FIG. 1*a* shows a body 10 having a recess 12 located in a fluid washed surface 14. A sacrificial anode 16 is located within the recess such that it is surrounded by a channel 18. The channel 18 is formed by the anode 16 being located within the recess 12 and separated from its sides such that a fluid can flow around and contact the sides of the anode 16.

The sacrificial anode 16 is constructed from a first material 20 and a second material 22. The first material 20 is more anodic than the second material 22 meaning that it has a higher anodic potential in a particular aqueous environment. In the present embodiment, the first material 20 is made from Magnesium and the second material 22 from Zinc and the body 10 is a steel structure and thus more cathodic than the first 20 and second materials 22 of the sacrificial anode 16. The electrolytic environment is provided by sea water. It will be appreciated that other anode-cathode material combinations are possible as exampled in table 1 below and that in some cases pure metals may be substituted with alloys which are commonly used for sacrificial anodes as known in the art.

TABLE 1

A list of suitable anode combinations.

| Bimetallic anode pair | Top surface of anode | Bottom (bulk) of anode |
|---|---|---|
| 1 | Zinc | Magnesium |
| 2 | Aluminium | Zinc |
| 3 | Aluminium | Magnesium |
| 4 | Mild steel | Magnesium |
| 5 | Mild steel | Zinc |
| 6 | Mild steel | Aluminium |

The first 20 and second materials 22 are directly bonded together so as to prevent the ingress of water and allow a good electrical connection between the two. Providing a good electrical connection allows an electrical circuit to be formed out of the steel, the anode and the sea. This allows the corrosion of the preferential corrosion of the first material and thus protects the second material from corrosion until the second material has been consumed. There are numerous techniques which can be used to bond dissimilar metals together such as ultrasonic welding, diffusion bonding, brazing, rotary friction welding and fiction stir welding, to mention a few.

The proportion of second material 22 to first material 20 will depend on the application but will be a balance between the expected amount of corrosion and the desired maintenance interval for example. The thickness of the second material 22 should be sufficient enough to be able to withstand mechanical damage which results from debris in the fluid flow and any hydrodynamic loads once the first material 20 has been consumed. Typically, the thickness ratio of the first material 20 to the second material will be approximately 1:9. However, the skilled person will appreciate that it may be preferential to have a range between 1:5 and 1:12.

The recess 12 is in the form of a well having straight sides and a flat bottom which is parallel to the fluid washed surface 14. However, other shapes and configurations of recesses will be possible within the scope of the invention.

The sacrificial anode 16 is mounted to the body 10 within the recess 12 on spacers in the form of pillars 26. The pillars 26 separate the anode 16 from the sides and bottom of the recess 12 within the body 10 so as to preserve the channel 18 which surrounds the anode 16. The size of the channel 18 will depend on the amount of fluid displacement required to provide satisfactory ionic exchange between the anode 16 and body 10.

The sacrificial anode 16 is fixed to the body 10 using bolts 28 which pass through the apertures in the anode 16 which extend from an upper surface of the anode to the underside, through the pillars 26 and which engage with threaded bores within the body 10. The bolts 28 are metallic and provide an electrical connection between the anode 16 and the body 10. It will be apparent to the skilled person that the pillars 26 and bolts 28 are made from a non-corrosive material such that mechanical support can be maintained throughout the life of the anode 16.

Providing an electrical connection between the anode and the body in this way allows an electron flow between the body 10 and anode 16 in use. Thus, there is an ionic flow between the anode and the body through the sea water and an electron flow through the bolts 28. It will be appreciated that the electrical connection can be made in other ways as known in the art.

The anode 16 is mounted within the body 10 such that the upper surface of the anode 16 lies in approximately the same plane as the fluid washed surface. In this way, the hydrodynamic profile of the fluid washed surface can be maintained.

An edge 30 of the body which is defined by the fluid washed surface and recess is rounded so as to have a curved profile which subtends at an angle of approximately 90° in the described embodiment. This feature encourages the flow of fluid through the channel 18 between the body 10 and anode 16, thus improving the flow of water around the anode, maintaining efficient operation. It will be appreciated that other features may be included to improve the flow of water in the channel 18.

In use, the body 10 is placed in a fluid flow (indicated by arrows 32) with the sacrificial anode 16 mounted a within the recess 12. The curved portion of the body 10 is placed upstream of the sacrificial anode 16 such that a flow of fluid is encouraged into the recess 12 and around the sacrificial anode 16. The presence of the seawater around the anode 16 and the galvanic relationship between the sacrificial anode 16 and the body 10 results in an electrochemical cell being set-up between the anode 16 and the body which prevent corrosion of the body 10 as described above.

Figure 1B:
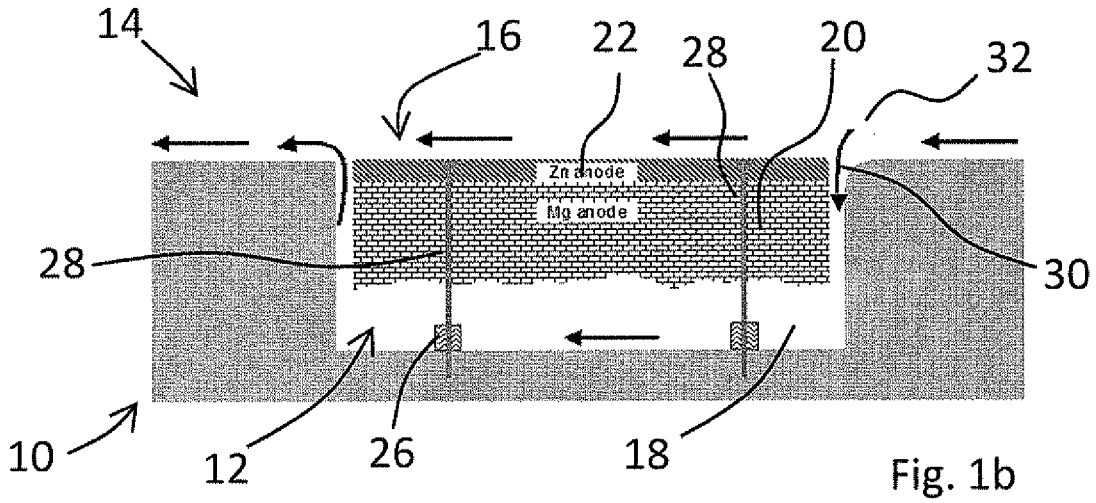
Figure 1C:
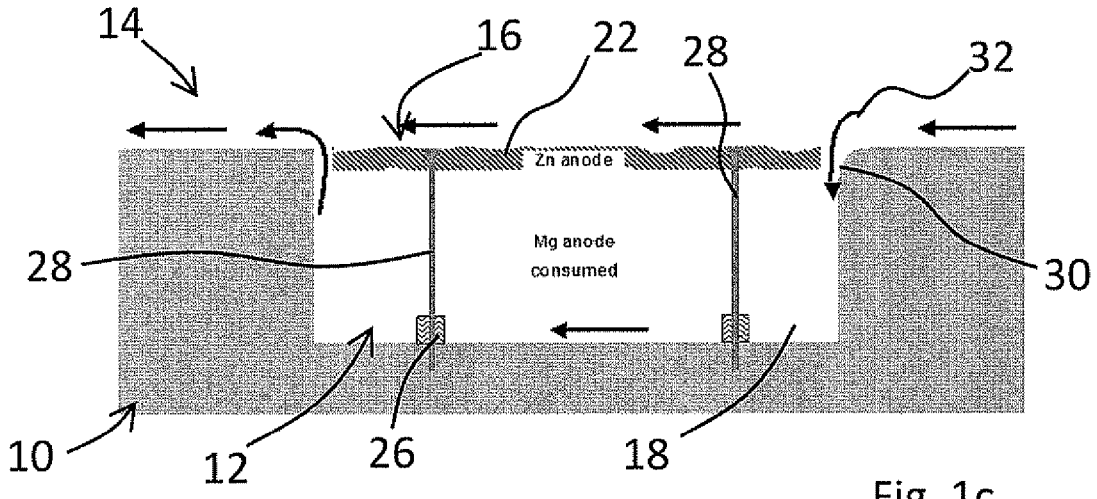

The ionic and electron flow results in the corrosion and consumption of the first of material 20 because it is more anodic than the body 10 and the second material 22. This is shown in FIG. 1*b* where the first material 20 is partially corroded, but the second material 22 is preserved. Once the first material 20 has been completely consumed, the second material 22 then becomes the sacrificial anode as shown in FIG. 1*c* and starts to corrode, while still providing protection to the body 10.

Because the corrosion of the second material 22 only occurs after the first material 20 has been entirely consumed, this provides a clear indication that the anode 16 needs to be changed. Thus, a person carrying out maintenance to the body 10 can readily identify whether the anode 16 needs to be replaced by assessing the condition and amount of corrosion of the second material. This may include determining whether the corrosion is greater or less than a predetermined amount. The predetermined amount may be related to the physical dimensions of the second material or to the surface appearance. Further, in one embodiment, there may be markers embedded in the second layer which become exposed after a particular amount of corrosion. This system of maintenance would not be possible if the second material 22 corroded at the same time as the first material 20 which is not readily observable as it is located within the recess 12.

Having a second material 22 which is less anodic than the first material 20 also means that it provides a protective layer for the fluid washed surface of the sacrificial anode 16. This means that the first material 20 corrodes from within the recess 12 and helps preserve the hydrodynamic profile of the body 10 and sacrificial anode 16.

The skilled person will appreciate that the clearance between the sacrificial anode 16 and the recess will be determined by the number of factors. For example, the salinity, temperature, and velocity of the fluid flow to name a few. Another important factor is the metal oxide which is formed as a part of the anode corrosion and dissolution process which will likely have a bigger volume than the parent metal and will partially fill the clearance round the anode. As will be appreciated, the volume of the oxide depends on the type of oxide formed and whether it is soluble or friable which may result in the oxide naturally eroding over time.

In one embodiment, the clearance is the same around all sides of the anode 16 and approximately between 10 and 20% of the minor dimension of the anode to account for possible variations in the oxide formation and maintain some water flow even under worst case conditions. For example, for an anode which is 10 cm thick and 40 cm long, the corresponding recess 12 in the body 10 should be approximately 11 to 12 cm deep and 42 to 44 cm long. A typical radius for the curved edge 30 of the recess in this case may be in the region of approximately 7 to 20 mm, depending on the operating environment.

Figure 2:
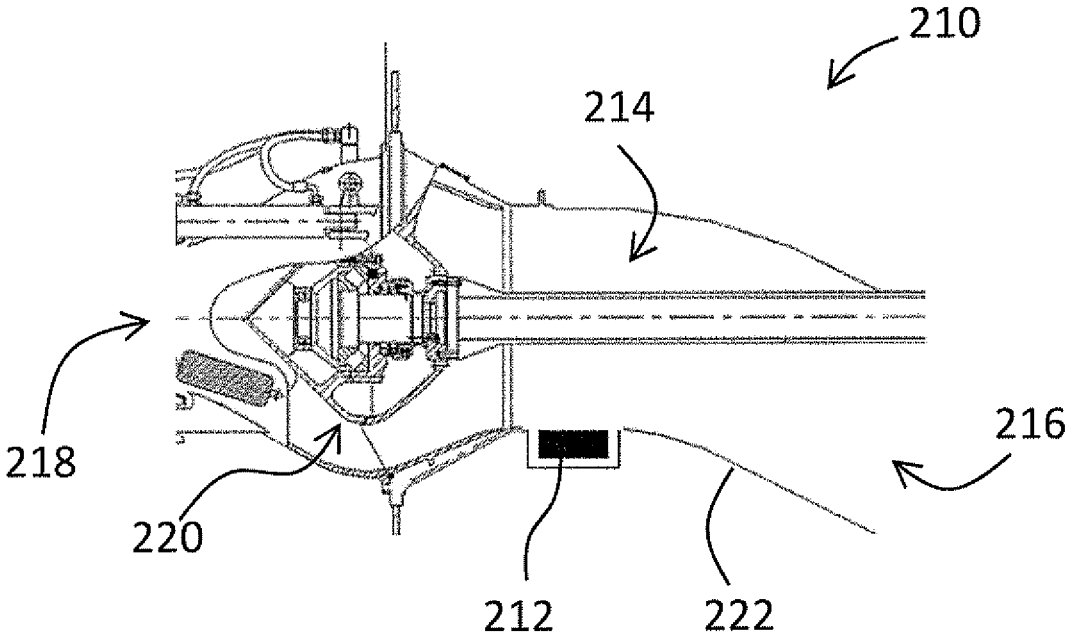
FIG. 2 shows a water jet propulsion unit with a sacrificial anode.

FIG. 2 shows a water jet propulsion unit 210 for a marine vessel which represents a typical example of an environment in which the sacrificial anode 212 of the invention may be used. The water jet includes a duct 214 having an inlet 216 for ingesting water, an outlet 218 for exhausting water so as to provide propulsion and a shaft driven impeller 220 arrangement for accelerating the water towards the outlet 218. The anode 212 can be seen as being recessed in a wall 222 of the duct 214.

The above described embodiments are examples of the invention defined by the claims and should not be taken as limiting. For example, although the first and second layers are described as being electrically connected together, this is an optional feature which prevents the protective second layer from corroding until all of the first material has corroded. The second layer may be provided simply to protect the sacrificial anodic layer and maintain the hydrodynamic profile.

The invention claimed is:

1. A metallic body comprising:

a sacrificial anode located within a recess of the metallic body, the sacrificial anode comprising:

a first layer of a first material; and, a second layer of a second material which is located proximate to the first layer, wherein the first material is more anodic with respect to a galvanic series than the second material, wherein the sacrificial anode is separated from the metallic body by a channel and electrically connected thereto, wherein the metallic body is more cathodic with respect to a galvanic series than the first and second materials, wherein the channel is formed by the anode being located within the recess and separated from sides of the channel such that a fluid can flow around and contact sides of the anode and a bottom surface of the recess, and wherein (i) the recess is defined by fluid washed surfaces of the metallic body and (ii) a surface of the second material is exposed and is located in a same plane as a fluid washed surface of the metallic body other than the fluid washed surfaces defining the recess.

2. A metallic body as claimed in claim 1 wherein the channel substantially surrounds the anode.

3. A metallic body as claimed in claim 1 wherein the recess has an opening to a fluid flow in normal use, the opening having a first dimension, wherein the sacrificial anode extends across up to 90% of the first dimension.

4. A metallic body as claimed in claim 1 wherein at least one edge between the fluid washed surface and a surface of the recess is shaped to encourage a flow of fluid into the recess.

5. A metallic body as claimed in claim 4 wherein the at least one edge has a curved profile which subtends between the fluid washed surface and surface of the recess.

6. A metallic body as claimed in claim 1 wherein the first layer and second layer are electrically connected together.

7. A metallic body as claimed in claim 1 wherein the first layer and second layer are directly bonded together.

8. A metallic body as claimed in claim 1 wherein the first material is magnesium.

9. A metallic body as claimed in claim 4 wherein the second material is zinc.

10. A metallic body as claimed in claim 1 wherein the ratio of the first material to the second material is between approximately 1:5 and 1:12.

11. A water jet propulsion unit comprising the metallic body as claimed in claim 1.

12. A water jet propulsion unit as claimed in claim 11 wherein the metallic body forms at least part of a duct through which water is propelled when the propulsion unit is in normal use.

* * * * *